United States Patent [19]

Kogej et al.

[11] Patent Number: 4,484,389

[45] Date of Patent: Nov. 27, 1984

[54] IMPROVED METHOD OF PRODUCING A SEMIFINISHED COMMUTATOR

[75] Inventors: Boris Kogej; Joze Potocnik, both of Idrija, Yugoslavia

[73] Assignee: Kolektor p. o., Idrija, Yugoslavia

[21] Appl. No.: 543,230

[22] Filed: Oct. 21, 1983

Related U.S. Application Data

[63] Continuation of Ser. No. 335,350, Dec. 29, 1981, abandoned.

[30] Foreign Application Priority Data

Sep. 29, 1981 [YU] Yugoslavia ..... 2346/81

[51] Int. Cl.[3] ..... H01R 43/08

[52] U.S. Cl. ..... 29/597; 310/235

[58] Field of Search ..... 29/597; 310/42, 43, 310/233–237

[56] References Cited

U.S. PATENT DOCUMENTS

| | | | |
|---|---|---|---|
| 2,963,774 | 12/1960 | Pike | 29/597 |
| 3,376,443 | 4/1968 | McColl | 29/597 |
| 3,468,020 | 9/1969 | Carlson et al. | 29/597 |
| 3,987,539 | 10/1976 | Gravener | 29/597 |
| 4,216,575 | 8/1980 | Carnavos et al. | 29/597 |

FOREIGN PATENT DOCUMENTS

| | | | |
|---|---|---|---|
| 1538960 | 4/1970 | Fed. Rep. of Germany . | |
| 1955122 | 5/1971 | Fed. Rep. of Germany . | |
| 45-5978 | 2/1970 | Japan | 29/597 |
| 1223677 | 3/1971 | United Kingdom . | |
| 2024667 | 1/1980 | United Kingdom . | |
| 2049496 | 12/1980 | United Kingdom . | |

*Primary Examiner*—Carl E. Hall

*Attorney, Agent, or Firm*—Fleit, Jacobson, Cohn & Price

[57] ABSTRACT

Anchoring elements of commutator lamellas are formed in a manner that of the inner circumference of the commutator mantle, longitudinal ribs 2 each having two longitudinal ridges 2*a* are formed by deforming without cutting, the material of starting outline A, such as by trenching by plowing, the material mainly moving in radial direction, whereby between the ribs 2 the longitudinal interspaces 3 are sharply defined. Subsequently, the ridges 2*a* are flattened by a flattening mandrel, whereby the prevailing part of the ridge mass is deformed in tangential direction into the area of the longitudinal interspaces 3.

5 Claims, 13 Drawing Figures

IMPROVED METHOD OF PRODUCING A SEMIFINISHED COMMUTATOR

Figure 1A:
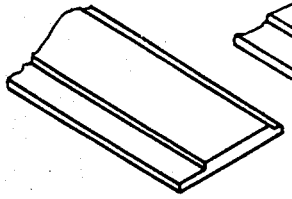

This application is a continuation, of application Ser. No. 335,350, filed Dec. 29, 1981 abandoned.

The invention relates to an improved method of producing a semifinished commutator, particularly the inner longitudinal ribs thereof. These ribs provide the lamellas of the commutator, and also serve as anchoring elements or elements from which anchoring elements can be formed.

The anchoring elements represent an important structural part of the lamellas of the commutator on the rotor of an electric motor. These anchoring elements provide firmness, rigidity and compactness to the commutator which is rotating at a high rate of rotation, counteracting the centrifugal force exerted on the lamella, on the one hand, and also counteracting the pullout torque acting on the lamellas as a result of the commutator brush bouncing against the longitudinal edge of the lamella in a circumferential direction, on the other hand.

In order to satisfy the required conditions of firmness of the lamellas or of the commutator as such, respectively, and still maintain an acceptable cost of manufacturing of the commutators, there have, according to prior art, been proposed various solutions which depend upon the initial shape of the blank, i.e. a copper band or a pipe.

According to the U.K. Pat. No. 1,223,667, as starting material a band of constant thickness is used into which evenly spaced projections of rectangular shape are punched in a longitudinal margin, in the opposite margin there also being punched evenly spaced but stepwise shaped projections, each projection being cut within the area of the gradation transversely to the orientation of the band; thus there are formed projections of greater length, which subsequently serve as terminals, and shorter projections, the length of which equal the length of the independent rectangular projections along the opposite margin of the band, the shorter projections serving as anchors.

Because a band of a constant thickness is used, a considerable thickness of the copper band to satisfy the conditions of firmness necessary where commutators of greater diameters and lengths and, additionally, of higher speeds of rotation are contemplated. By providing along one margin of the band alternately terminals and anchors, it becomes evident that for geometrical reasons these commutators are only convenient for a smaller number of lamellas, whereby the range of application thereof becomes limited. The anchors are formed by inwardly folding said shorter projections; consequently, the lamellas are anchored by their ends, for which reason the lamellas are, as a whole, during operation exposed to the action of the centrifugal force, being thereby exposed to the risk of being separated from the moulding preparation. The insulating channels are very deep, requiring complicated tools to manufacture a punched blank. Beside punching itself, a cutting operation is also involved, to fold the anchors and to mould the insulating plastic. Thus there is a substantial quantity of waste material as a result of the punching operation. These are the essential constructional and technological disadvantages of the cited solution.

As starting material according to the published German patent application No. 1 955 122 likewise a band is used which first is longitudinally rolled, whereby through plastic deformation both the transversely oriented ribs and, additionally, a smoothly rolled margin are manufactured, one longitudinal section of said rolled margin to be, optionally, of reduced thickness. This margin is then punched in the area between the ribs to yield the terminals; subsequently, the band, deformed in the above-mentioned manner and cut to a suitable length, is transformed into a cylindrical shape. In one operation the terminals are bent outwards; in a subsequent operation, the internal ribs are cut from both ends in an axial direction and the cut sections are bent towards the axis of the article, thereby forming the anchoring elements of the lamellas.

It was also found that a complicated and expensive profiled tool is required for rolling the band, the material failing to be uniformly wrought along the longitudinal and transversal cross-section, within the band there appearing residual tensions resulting from deforming the rolled article in a longitudinal direction. The nonuniform hardness of the copper across the width of the lamella results in a nonuniform wearing of the brushes.

In the field of manufacturing commutators using a tube as a blank, the initial approach is analogous to that approach described above when using the band. In some cases the blank was a smooth tube and in other cases from a profiled tube. As for the rest, there appear analogous disadvantages as described above.

An object of the invention is to improve known methods of manufacturing commutators and the commutator itself as such in a manner that with respect to cost and to constructional as well as technological aspects, whereby a satisfactory commutator is attached, having a scope of application in no way limited.

This aim is achieved by starting with a smooth band, both margins of which and, if necessary (depending upon the length of the commutator) also the intermediate longitudinal area of which are smoothly rolled in a manner known per se to thereby reduce the thickness of said areas, the width of one of the margins being greater than the width of the other one. If necessary, into this margin evenly spaced projections (subsequent terminals) can be formed by punching. After the band treated in the above manner has been cut to an adequate length, cylindrical ring elements are formed.

In another embodiment of the above process a smooth tube cut to a corresponding length is used as a blank, the thickness of the tube at its end sections reduced by inwardly upsetting the internal layer of the material and subsequently trimming the article by removing the superfluous material. The tube element treated in the above manner and the ring element disclosed above are adequate with respect to performing the next, i.e. inventive, step of manufacturing elements of lamellas.

The anchoring elements for the subsequent lamellas of the commutator are manufactured from the internal layer of the blank material first by deforming without cutting the material, such as trenching by plowing, whereby a plurality of ribs at equally spaced positions about the circumference of the interior surface of the commutator are formed, each of the ribs having a V-notch at its tip; the V-notch comprising two longitudinal ridges and a longitudinal groove. Between each rib are interspaces. Following this step, in the subsequent operation the ridges are flattened by a flattening mandrel, the prevailing part of the ridge mass thus being deformed in tangential direction into the area of said interspaces. The interspaces are thereby partly blinded to the interior of the commutators; exactly in this constructional feature there lies the anchoring function of the ribs, i.e. the subsequent lamellas.

If necessary, it is possible to cut ribs formed in described manner, from both ends thereof in axial direction in known manner, and to bend the split sections towards the axis of the commutator.

By partly kneading the mantle mass and using the same for forming the longitudinal ribs, there are achieved shallow insulating channels and, with regard to the rigidity of the ribs or anchoring elements, advantageous cross-sections thereof without necessitating the use of sophisticated tools.

Further finishing of the commutator ensues in known manner, therefore a repetition of the relevant description will be avoided.

Figure 1B:
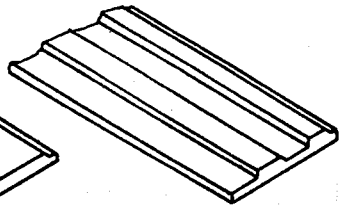
Figure 1C:
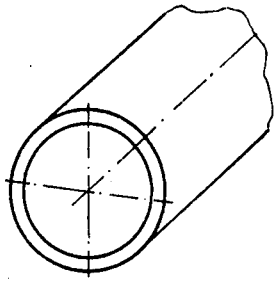
Figure 2A:
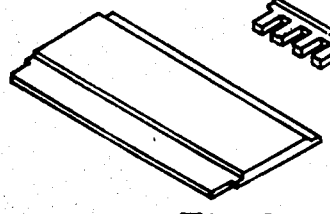
Figure 2B:
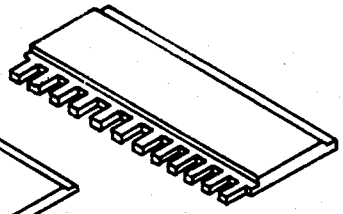
Figure 2C:
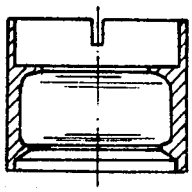
Figure 3A:
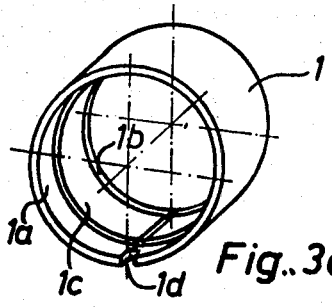
Figure 3B:
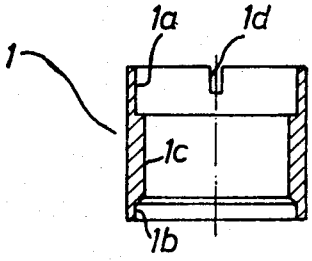
Figure 4A:
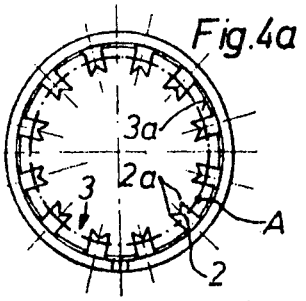
Figure 4B:
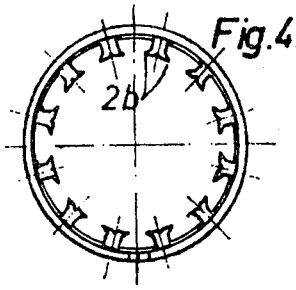
Figure 5A:
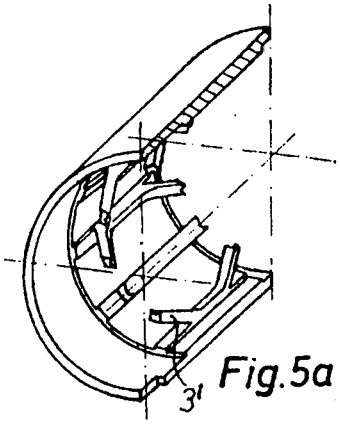
Figure 5B:
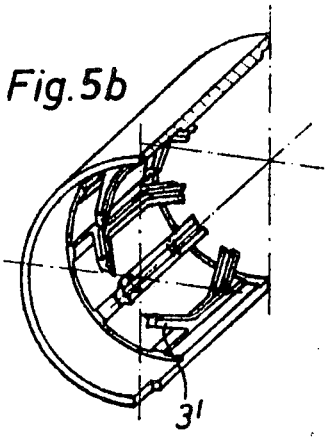
Figure 6:
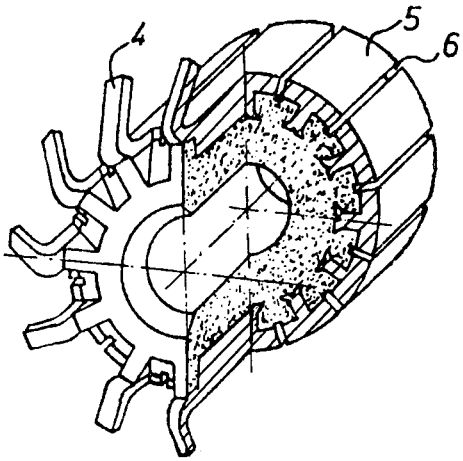

The invention will hereinafter be disclosed in more detail by way of embodiments shown in the attached drawing. Therein show:

FIG. 1*a* a sample of a rolled band blank with longitudinal margins of reduced thickness;

FIG. 1*b* a sample of a rolled band blank with longitudinal margins and an intermediate strip area of reduced thickness;

FIG. 1*c* a sample of a tube blank having a smooth wall;

FIG. 2*a* a rolled article cut to a suitable length, of FIG. 1*a*, with indicated orienting recess;

FIG. 2*b* an element of FIG. 2*a*, provided with terminals;

FIG. 2*c* a tube blank of FIG. 1*c* after finished upsetting of the end sections and forming of the orienting recess;

FIG. 3*a* an article of FIG. 2*a* after deformation into a cylindrical form;

FIG. 3*b* an article of FIG. 2*c* after trimming thereof, when the superfluous material has been removed;

FIG. 4*a* an article according to the invention subsequently to the operation of deforming without cutting the inner layer of material;

FIG. 4*b* an object of FIG. 4*a* after the ridges of the ribs have been flattened;

FIGS. 5*a*, 5*b* two samples of an application of known forming of anchoring elements by cutting in the ribs obtained according to the proposed method; and FIG. 6 a finished commutator pressed out with an insulating moulded plastic, where the object of the invention has been applied, the commutator being shown in a partly broken elevation.

From FIGS. 1 to 3 it is evident that forms of blanks and technological operations, respectively, for manufacturing thereof are those which are convenient with regard to cost and constructional aspect. In view of the fact that the substance of the invention is not present until the step shown in FIG. 4*a*, a detailed description of the preceding operations is omitted for practical reasons.

The starting element for embodying the invention is a cylindrical mantle 1 according to either FIGS. 3*a* or 3*b*. The mantle is in this case provided with end sections 1*a*, 1*b* of reduced thickness and an intermediate section 1*c* of greater thickness. For realizing further manufacturing steps, within the section 1*a*, the axial dimension of which is greater than the one of the section 1*b* lying opposite thereto and which is foreseen for forming terminals (cf. FIG. 6), there is provided an orienting recess 1*d*.

FIG. 4*a* shows the cylindrical mantle 1 after the inner layer of the mantle material has been treated by deforming without cutting, such as trenching by plowing. By a dash-and-dot line A there is indicated the starting internal outline of the section 1*c* having greater thickness. This section was subjected to a deforming operation, trenching by plowing, whereby the material of the inner layer of the section 1*c* was spaced apart by movement in a mainly radial direction, forming longitudinal ribs 2 each having two longitudinal ridges 2*a*. After removing the plowing tool not shown in the drawing, but consisting of quite simple needle-shaped elements arranged in a ring, there appear between ribs 2 longitudinal grooves 3, the bottom 3*a* of which lies essentially closer to the external surface of the cylindrical mantle 1 than to the starting inner outline A. Thus the desired reduction in the thickness of the material collar which is subsequently longitudinally cut (cf. FIG. 6) is obtained.

FIG. 4*a* also shows the cross-section of the ribs 2, which is advantageous as regards rigidity. There is obtained essentially a rectangular cross-section which, with respect to rigidity, is more advantageous than the cross-section of prior art ribs manufactured by rolling, these prior art ribs therefore having an involute or similar profile.

In the next manufacturing step, a cylindrical mandrel, which is not shown and which can space apart the material of ridges 2*a* tangentially to one or the other side of ribs 2 into the area of neighbouring interspaces 3, is forced into the interior of the profiled mantle 1. FIG. 4*b* shows the construction of the article after completing said step. The initial ridges 2*a* are now transformed to ridges 2*b* which with respect to their shape and orientation form anchoring elements for the subsequent lamellas.

With respect to given geometrical or dynamic relations the article can either in the manufacturing step according to FIG. 4*a* or subsequently to the manufacturing step according to FIG. 4*b* further be treated in known manner wherein the ribs 2 are longitudinally cut to form the anchoring prongs 3' as evident from FIGS. 5*a*, 5*b*.

Subsequently, the commutator is pressed out with an insulating moulded plastic, the end section 1*a* not pressed out with said plastic being sawn to form terminals 4, the mantle 1 being longitudinally sawn as well to form lamellas 5 separated from one another by channels 6. FIG. 6 shows such form of the commutator.

What is claimed is:

1. A method of forming anchoring elements of commutator lamellas comprising:

(1) providing an appropriately shaped blank having a smooth interior and exterior surface;

(2) forming, by deforming without cutting only the interior surface of said blank, a plurality of ribs at equally spaced positions about the circumference of an interior surface of said blank without deforming the exterior surface of said blank, each rib having a V-notch at its tip, said V-notch comprising two longitudinal ridges and a longitudinal groove, said ribs at equally spaced positions forming longitudinally interspaces; and (3) subsequently flattening said ridges of said V-notch where the ridge mass is deformed in tangential direction into the area of the longitudinal interspaces.

2. A method according to claim 1 wherein the appropriately shaped blank of (1) is formed by rolling a band to produce margins of reduced thickness, subsequently cutting said bands to the appropriate length, and forming said bands into rings.

3. A method according to claim 1 wherein the appropriately shaped blank is formed by cutting a tube to an appropriate length, reducing the thickness of the tube at its end sections, and subsequently trimming off the superfluous material resulting from the reducing step.

4. The method according to claim 1 and further comprising cutting the ribs from both ends in an axial direction and bending the ends of said ribs toward the axis of the commutator to form anchoring prongs.

5. A method of forming anchoring elements of commutator lamellas comprising:

(1) rolling a smooth band to reduce the thickness of each margin of said smooth band;

(2) forming said smooth band from (1) into a ring;

(3) forming, by deforming without cutting only the interior surface of said ring, a plurality of ribs at equally spaced positions about the circumference of the interior surface of said ring without deforming the exterior surface of said blank, each rib having a V-notch at its tip, said V-notch comprising two longitudinal ridges and a longitudinal groove, said ribs at equally spaced positions forming longitudinal interspaces;

(4) subsequently flattening said ridges of said V-notch where the ridge mass is deformed in tangential direction into the area of said longitudinal interspaces by a flattening mandrel; and (5) cutting said ribs from both ends in an axial direction and bending said ribs toward the axis of the commutator to form anchoring prongs.

* * * * *